US006111176A

United States Patent [19]

Rose

[11] Patent Number: 6,111,176

[45] Date of Patent: Aug. 29, 2000

[54] STRING ASSEMBLY INCLUDING ONE OR MORE ANCHORS FOR USE WITH A STRINGED INSTRUMENT

[76] Inventor: Floyd D. Rose, 117 Via de la Valle, Del Mar, Calif. 92014

[21] Appl. No.: 09/239,099

[22] Filed: Jan. 28, 1999

[51] Int. Cl.[7] ..... G10D 3/00

[52] U.S. Cl. ..... 84/297 S; 84/297 R

[58] Field of Search ..... 84/297 S, 297 R

[56] References Cited

U.S. PATENT DOCUMENTS

| | | | |
|---|---|---|---|
| 2,976,755 | 3/1961 | Fender | 84/727 |
| 3,678,795 | 7/1972 | Fullerton | 84/293 |
| 3,763,736 | 10/1973 | Williams | 84/329 |
| 3,911,777 | 10/1975 | Rendell | 84/743 |
| 3,911,778 | 10/1975 | Martin | 84/267 |
| 3,915,049 | 10/1975 | Bean | 84/743 |
| 4,027,570 | 6/1977 | Rendell et al. | 84/293 |
| 4,111,093 | 9/1978 | Field et al. | 84/267 |
| 4,135,426 | 1/1979 | Rickard | 84/743 |
| 4,142,435 | 3/1979 | Pozar | 84/727 |
| 4,201,108 | 5/1980 | Bunker | 84/743 |
| 4,241,637 | 12/1980 | Brent | 84/743 |
| 4,283,982 | 8/1981 | Armstrong | 84/728 |
| 4,377,101 | 3/1983 | Santucci | 84/743 |
| 4,425,831 | 1/1984 | Lipman | 84/743 |
| 4,433,603 | 2/1984 | Siminoff | 84/726 |
| 4,462,295 | 7/1984 | Hundley | 84/743 |
| 4,472,994 | 9/1984 | Armstrong | 84/726 |
| 4,522,101 | 6/1985 | Peavey et al. | 84/743 |
| 4,573,391 | 3/1986 | White | 84/291 |
| 4,638,708 | 1/1987 | Kamal | 84/293 |
| 4,793,236 | 12/1988 | McGuire et al. | 84/293 |
| 4,803,906 | 2/1989 | Fender | 84/293 |
| 4,840,102 | 6/1989 | Pittman | 84/293 |
| 4,854,210 | 8/1989 | Palazzolo | 84/726 |
| 4,905,563 | 3/1990 | Davies | 84/291 |
| 4,939,970 | 7/1990 | Hoshino et al. | 84/293 |
| 4,982,640 | 1/1991 | Buscarino | 84/293 |
| 5,012,716 | 5/1991 | Pagelli | 84/727 |
| 5,014,588 | 5/1991 | Omata et al. | 84/726 |
| 5,033,353 | 7/1991 | Fala et al. | 84/72 |
| 5,052,269 | 10/1991 | Young, Jr. | 84/728 |
| 5,072,646 | 12/1991 | Valkama | 84/726 |
| 5,125,311 | 6/1992 | Boulanger et al. | 84/291 |
| 5,136,918 | 8/1992 | Riboloff | 84/723 |
| 5,337,643 | 8/1994 | Cantrell | 84/293 |
| 5,347,904 | 9/1994 | Lawrence | 84/291 |
| 5,353,672 | 10/1994 | Stewart | 84/291 |
| 5,390,578 | 2/1995 | Raymer | 84/291 |
| 5,398,581 | 3/1995 | Castillo | 84/291 |
| 5,421,233 | 6/1995 | Bunder | 84/293 |
| 5,452,637 | 9/1995 | DeCola | 84/291 |
| 5,458,035 | 10/1995 | Okamura | 84/293 |
| 5,477,764 | 12/1995 | Carrico | 84/297 R |
| 5,519,165 | 5/1996 | Gregory | 84/293 |
| 5,549,027 | 8/1996 | Steinberger et al. | 84/297 R |
| 5,567,903 | 10/1996 | Coopersmith et al. | 84/723 |
| 5,589,653 | 12/1996 | Rose | 84/314 N |
| 5,600,078 | 2/1997 | Edwards | 84/307 |
| 5,614,688 | 3/1997 | Donnel | 84/743 |
| 5,631,432 | 5/1997 | Muncy | 84/293 |
| 5,637,823 | 6/1997 | Dodge | 84/743 |
| 5,661,252 | 8/1997 | Krawczak | 84/291 |
| 5,679,910 | 10/1997 | Steinberger et al. | 84/291 |
| 5,717,150 | 2/1998 | Rose | 84/297 S |

*Primary Examiner*—David Martin
*Assistant Examiner*—Shih-yung Hsieh
*Attorney, Agent, or Firm*—Lerner, David, Littenberg, Krumholz & Mentlik, LLP

[57] ABSTRACT

A stringed instrument, such as a guitar having unique string assemblies is provided. The string assembly includes a string and anchor elements arranged on at least one end of the string. A method of manufacturing string assemblies which include a string and one or more anchor elements arranged at the ends of the string is also provided.

34 Claims, 2 Drawing Sheets

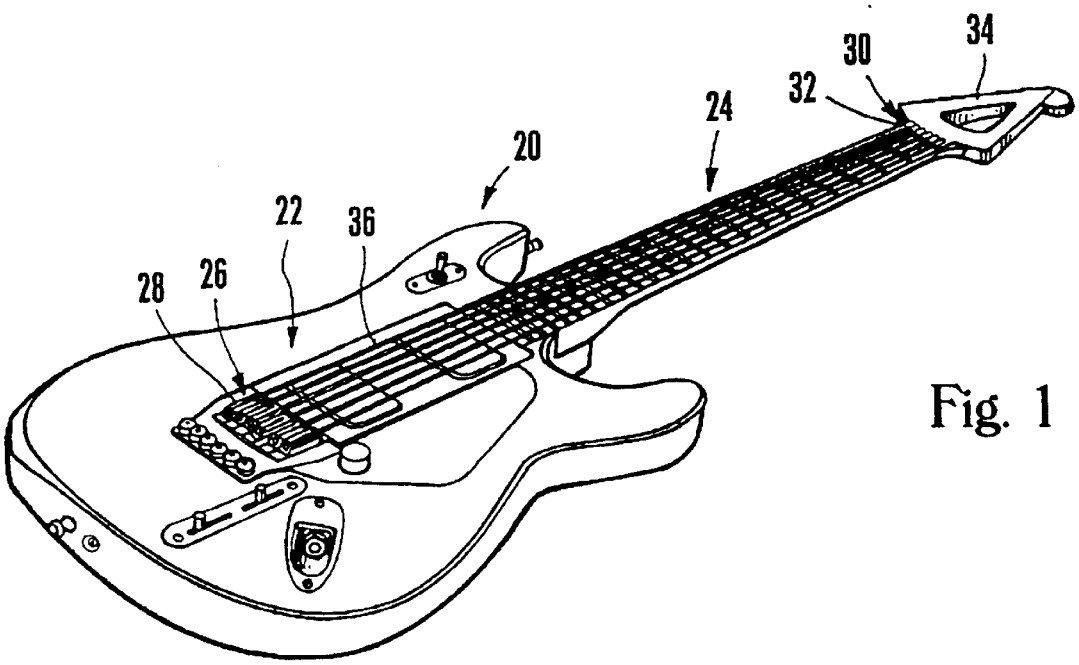
Fig. 1
Fig. 2
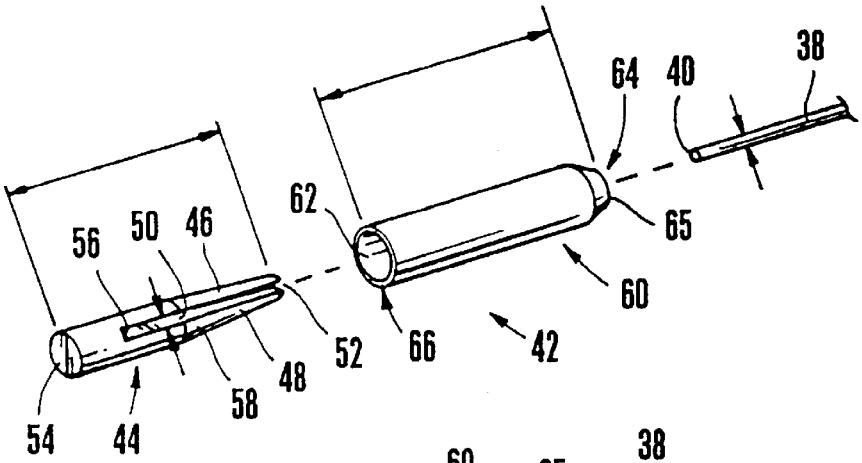
Fig. 3
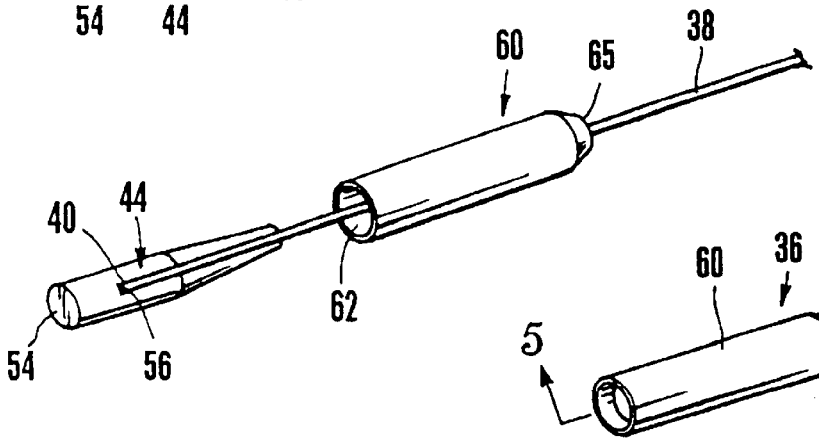
Fig. 4
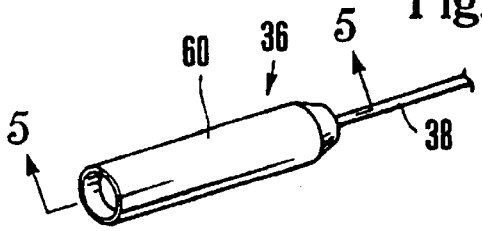

STRING ASSEMBLY INCLUDING ONE OR MORE ANCHORS FOR USE WITH A STRINGED INSTRUMENT

FIELD OF THE INVENTION

The present invention relates to stringed instruments, such as guitars. More particularly the present invention relates to strings that include an anchor at one or both ends thereof, for use with stringed instruments.

BACKGROUND OF THE INVENTION

Conventional guitars, and other stringed instruments, include strings placed under tension which extend at a substantially constant height above a fretboard mounted on the neck of the instrument. In order to produce sounds associated with musical notes, the strings are placed in contact with two critical contact points. The first critical contact point is generally at the nut of the instrument, which in the case of a guitar, is usually arranged on the neck adjacent to the first fret of the fretboard. The second critical contact point is generally at the bridge of the instrument, which is provided on the body beyond an opposing end of the fretboard. The strings are fixed at a distance beyond the critical contact points at the nut and bridge.

Inventors have made efforts to improve the mounted arrangement of strings with respect to nut and bridge critical contact surfaces. For example, in recent years, the inventor of the present invention developed string assemblies including a string and bullet-shaped anchors secured to both ends thereof. That system is disclosed in U.S. Pat. No. 5,717,150. The '150 patent also discloses a guitar having a nut assembly and a bridge assembly where a bullet-shaped anchor at one end of the string is secured in a string holder of the nut assembly while a bullet-shaped anchor at the other end of the string is secured in a corresponding saddle of the bridge assembly. While the guitar and associated strings disclosed in the '150 patent represent substantial improvements over the previous state of the prior art, it fails to disclose the use of a two-piece anchor which substantially facilitates manufacture of the string assembly.

U.S. Pat. No. 4,696,218 discloses an effort to simplify the tuning process of a guitar where strings are provided having a ball affixed at a first end. The strings are sold to a user in that state, and the user then secures a unitary ball at a second position on the string. The '218 patent does not teach the use of a two-piece anchor.

U.S. Pat. No. 4,608,904 also discloses a string having a ball affixed to each end thereof. The strings are affixed to a string holding device beyond the nut critical contact points at one end, and are affixed to slidable members at a second end beyond corresponding bridge critical contact points. There is no disclosure or teaching in the '904 patent for the ball-shaped anchors to include two components.

The prior art does not disclose or teach various aspects of the present invention such as a string assembly including a string and a two-piece anchor.

SUMMARY OF THE INVENTION

The present invention overcomes the shortcomings of the prior art by providing a string assembly including a string having at least one end precisely located in an anchor assembly.

In a preferred embodiment, a string assembly for use with a stringed instrument comprises a string having a first end a second end. A two-piece anchor may be arranged at the first end of the string. The two-piece anchor may include a clamp and a sleeve. The clamp may include first and second side walls, an open front section, a closed rear section connected between the first and second side walls, and a passageway extending along the first and second side walls from the open front section to the closed rear section. The first end of the string may be arranged within the passageway of the clamp, and the sleeve may be circumferentially arranged around the clamp so that the clamp is compressed on the string whereby the first end of the string is locked into assembled position within the anchor.

Preferably, the first end of the string is arranged in abutment with the closed rear section of the clamp and is then locked into assembled position within the anchor. The anchor may comprise a bullet-shape configuration, or various other geometric configurations.

It is also preferable for the clamp to include first and second opposing slots separating the first and second side walls. The sleeve of the two-piece anchor may comprise a hollow cylinder having tapered end walls which act to compress the clamp upon insertion into the sleeve.

Preferably, the string assembly comprises a second anchor, where the second anchor is connected to the second end of the string. Thus, in this preferred embodiment, the string has anchors arranged at both ends thereof.

In one preferred embodiment, the sleeve of the two-piece anchor includes an open front section, an open rear section, and a passageway extending through the open front and rear sections, where the passageway has a greater circumference at the rear section than the front section. The sleeve may have a shoulder adjacent the passageway at the open front section, and the shoulder may be the forward-most portion of the anchor when the string assembly is arranged in assembled position on a stringed instrument.

In another preferred embodiment, the passageway of the sleeve may have a greater circumference at the front section than the rear section. In this embodiment, the clamp may include a shoulder adjacent the passageway at the open front section thereof where the shoulder is the forward-most portion of the anchor when the string assembly is arranged in assembled position on a stringed instrument.

Another aspect of the present invention relates to an entire stringed instrument which comprises a body, a neck mounted on the body, a bridge mounted on the body, a nut connected to the neck, and a plurality of string assemblies extending between the bridge and the nut. Each of the string assemblies may include the features of the preferred string assemblies discussed above.

Yet another aspect of the present invention is directed toward a method of securing an anchor to a guitar string. The method preferably comprises the steps of providing a string and a two-piece anchor assembly including a clamp and a sleeve where the clamp has an open front section, a closed rear section and a passageway extending from the open front section to the closed rear section. The method also preferably comprises the step of arranging an end of the string within the passageway of the clamp in abutment with the closed rear section thereof. It is also preferable for the method to comprise the step of arranging the sleeve over the clamp and forcing the clamp into the sleeve to a desired position where the string is locked in assembled position within the anchor such that the end of the string remains in abutment with the closed rear section of the clamp.

The step of forcing the clamp into the sleeve may comprise initially placing the open front section of the clamp through the open rear section of the sleeve and forcing the clamp toward the open front section of the sleeve until the front section of the clamp is at a predetermined position with respect to the front section of the sleeve whereby a tapered passageway of the sleeve compresses the clamp to lock an end of the string into assembled position within the anchor.

The method may also comprise using a machine including a plunger to force the clamp toward the open front section of the sleeve. The machine may include a micrometer used to control insertion of the clamp within the sleeve to a desired position.

In accordance with another preferred method, the step of forcing the clamp into the sleeve may comprise initially placing the closed rear section of the clamp through the open front section of the sleeve, and forcing the clamp toward the open rear section of the sleeve whereby the tapered passageway compresses the clamp to lock an end of the string into assembled position within the anchor.

In accordance with such method, the clamp may be forced rearwardly into the sleeve at a predetermined set pressure.

In yet another preferred method of securing an anchor to a guitar string, the rear section of the clamp need not be closed. Instead of arranging an end of the string in abutment with the closed rear section of a clamp, a different means of precisely locating an end of the string with respect to the rear section of the clamp may be utilized. For example, the string may be placed in abutment with an external locating mechanism. The string may be maintained in such precisely located position while a sleeve is forced over the clamp to lock the string into assembled position.

The above features and advantages of the present invention will be more fully understood with reference to the following detailed description when taken in conjunction with the accompanying drawings.

BRIEF DESCRIPTION OF THE DRAWINGS

FIG. 1 is a perspective view of a guitar including the string assembly of the present invention.

FIG. 2 is an exploded view taken at one end of the string assembly illustrating the components of a preferred embodiment of the present anchor.

FIG. 3 is a disassembled view of one end of the string assembly with a string partially arranged in a portion of the present anchor.

FIG. 4 is an assembled view of the string assembly having one end secured within the present anchor.

DETAILED DESCRIPTION OF THE PREFERRED EMBODIMENTS

Figure 5:
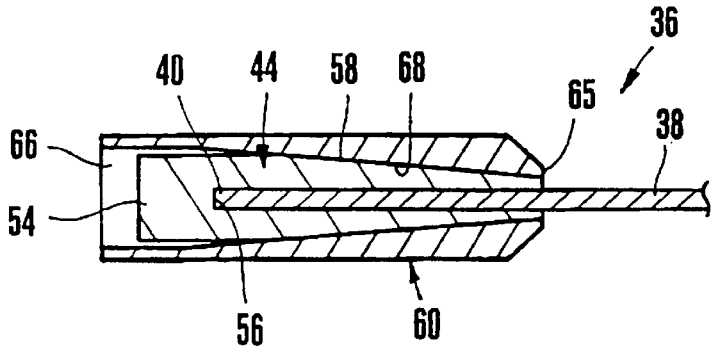
FIG. 5 is a cross-sectional view of one end of the string assembly taken along line 5—5 shown in FIG. 4.

An electric guitar 20 in accordance with a preferred embodiment of the present invention is shown in FIG. 1. It should be appreciated that various other stringed instruments such as acoustic guitars, violins, banjos and the like are covered within the scope of the present invention.

The guitar 20 includes a body 22 and a neck 24 connected to the body. A headstock 34 is connected, either directly or indirectly, to an end of the neck 24. A fretboard (unnumbered) is preferably arranged on the neck extending between a first end near the headstock 34 and a second end where the neck 24 is connected to the body 22 of the guitar 20.

A bridge assembly 26 is mounted on the body 22, and includes a plurality of saddles 28. As shown in FIG. 1, the saddles 28 are used to secure an anchor assembly at one end of an associated string.

A nut assembly 30 is connected to the end of the neck 24 adjacent to the headstock 34. As shown in FIG. 1, the nut assembly 30 comprises a plurality of string holder cavities 32, which secure an anchor at a second end of the string remote from the anchor secured in a corresponding one of the saddles 28.

Preferred embodiments of the features of bridge assembly 26 and the nut assembly 30 are disclosed in U.S. Pat. No. 5,717,150, the disclosure of which is incorporated by reference herein, and in a co-pending application filed by the same inventor of the present invention.

An important aspect of the present invention relates to a string assembly 36, either by itself or as incorporated into a stringed instrument, such as guitar 20. String assembly 36 includes the combination of a string 38 with two-piece anchor 42, which is shown in FIGS. 2–6 and will be described in more detail below. String 38 includes a first end 40 and a second end, which is not shown in the drawing, as it is identical in structure to end 40.

The two-piece anchor 42 includes a clamp 44 and a hollow cylindrical shell 60. The clamp 44 includes a first side wall 46 and an opposing second side wall 48. A slotted passageway 50 extends between the first and second side walls 46 and 48. As shown in FIGS. 2, 3, 5 and 6, the clamp 44 includes an open front section 52 and a closed rear section 54. The slotted passageway 50 extends from the open front section 52 to an inside surface 56 of closed rear section 54. The clamp 44 also includes tapered outer walls 58 that have a relatively small diameter near the front section of clamp 44, and a relatively large diameter near the rear section 54 of clamp 44.

As also shown in FIGS. 2, 3, 5 and 6, the second component of anchor 42, sleeve 60 includes a passageway 62 which extends between an open front section 64 and an open rear section 66. An external portion of sleeve 60 forms the front most shoulder 65 of the anchor 42 when the clamp 44 is assembled within the sleeve 60 as shown in FIGS. 4 and 5. As also shown in FIG. 5, sleeve 60 includes inner tapered walls 68, which substantially correspond in diameter to the tapered outer walls 58 of clamp 44. The tapered inner walls 68 of sleeve 60 have a relatively small diameter near the open front section 64, and a relatively large diameter near the open rear section 66.

When in assembled position, the clamp 44 of anchor 42 is arranged within sleeve 60. Further, when assembled, the end 40 of string 38 abuts the inside surface 56 of closed rear section 54, which serves as a locator for the end 40 of string 38. This aspect of the present invention is particularly important where it is desirable for the string assembly 36 to be manufactured to precise tolerances, such as when being used in a convergence tuning system (i.e., where pitch and harmonic tuning is simultaneously achieved) as described in U.S. Pat. No. 5,717,150, the disclosure of which has been incorporated by reference herein.

In such convergence tuning systems, it is important to know the overall length of string 38. In the embodiment shown in FIGS. 2–6, the forward-most shoulder 65 is arranged on the sleeve 60. When the string assembly 36 is arranged in assembled position within corresponding saddles 28 and string holder cavities 32 of guitar 20, it is desirable for the location where the string 38 to exit the two-piece anchor 42 adjacent to the forward-most shoulder 65 of anchor 42. This location is considered the termination point and designates an effective end of the string 38. In convergence tuning systems, such as the system disclosed in the '150 patent, the length of the strings 38 between the effective ends thereof (i.e., between the termination points) may be important.

In the embodiment shown in FIGS. 2–6, the dimensions of the tapered inner wall 68 of the sleeve 60, and the tapered outer wall 58 of the clamp 44 are selected so that the clamp 44 is force-fitted into the passageway 62 of the sleeve 60, but preferably does not extend beyond the forward-most shoulder 65 thereof. This structural arrangement is reversed in a second embodiment of the present invention (shown in FIGS. 6, 7 and 8). However, both embodiments incorporate the important feature of a closed rear section as part of the clamp so that an end of the string can be precisely located within the anchor.

It should also be appreciated that the preferred embodiments of the anchors disclosed herein are bullet-shaped. However, in alternate embodiments, the anchors may have various configurations including without limitation, square or oval, etc.

Figure 6:
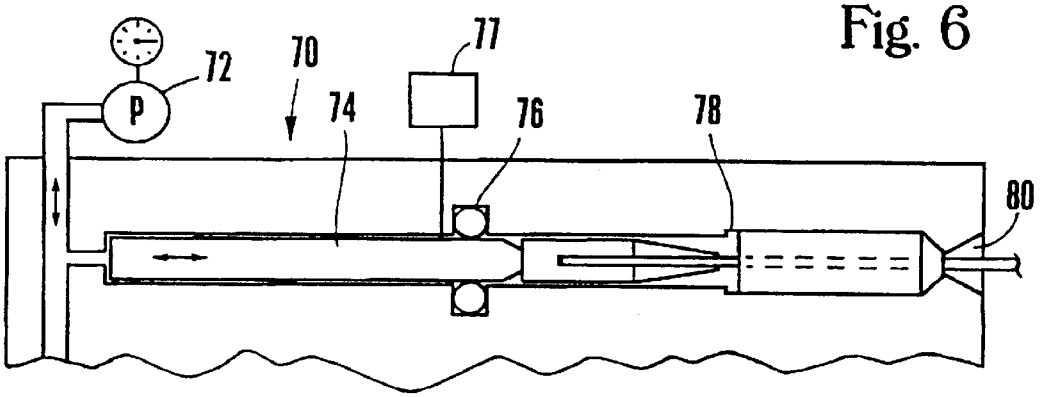
FIG. 6 is a schematic view of a machine used to manufacture the string assembly of the present invention.

FIG. 6 illustrates a schematic view of a machine 70 which can be used to manufacture the string assembly 36 of the present invention. It should be appreciated that machine 70 is shown by way of example only, as various types of machines can be used to manufacture the string assembly 38 of the present invention. Further, although machine 70 is shown by way of example as including one section for assembling anchor 42 on string 38, other suitable machines may include two or more sections for concurrently assembling string assemblies.

In accordance with a preferred method of manufacturing the string assembly, the string 38 is placed through the passageway 62 of sleeve 60 and into passageway 50 of clamp 44 until the end 40 abuts the inside surface 56 of closed rear section 54 of clamp 44. The clamp 44 is then forced through the open rear section 66 of sleeve 60 and into the passageway thereof. As the clamp 44 proceeds toward the open front section 64 of sleeve 60, the tapered outer walls 58 of the clamp 44 engages the inner walls 68 of sleeve 60. The string 38 is then compressed within the clamp 44 until it is locked into assembled position with the end 40 abutted against the inside surface 56 of the closed rear section 54.

As schematically illustrated in FIG. 6, a machine 70 includes a regulated pressure source 72 and a piston 74 which is pneumatically actuated by pressure source 72. A sealing device, such as o ring 76 is provided to prevent pressure leaks. The machine 70 includes a sized holding cavity 78 which retains sleeve 60 in a fixed position as an end of piston 74 abuts against the outside surface of closed rear section 54 of anchor 44 to force anchor 44 into assembled position within the passageway 62 of sleeve 60. A passageway 80 is arranged adjacent to the holding cavity 78 to permit the end 40 of string 38 to be placed through the passageway of sleeve 60 and passageway 50 of clamp 44.

The pressure required to force the clamp 44 into assembled position within collar 60 may vary depending upon the particular materials that the components are made of, the dimensions of the components, manufacturing tolerances, etc. In a preferred embodiment, the clamp 44 and collar 60 are made of brass. However, to assure that the distance between the forward most shoulder 65 of sleeve 60 and the located position of the end 40 of string 38 is consistently maintained, a micrometer 77 is used to account for deviations in manufacturing tolerances.

Figure 7:
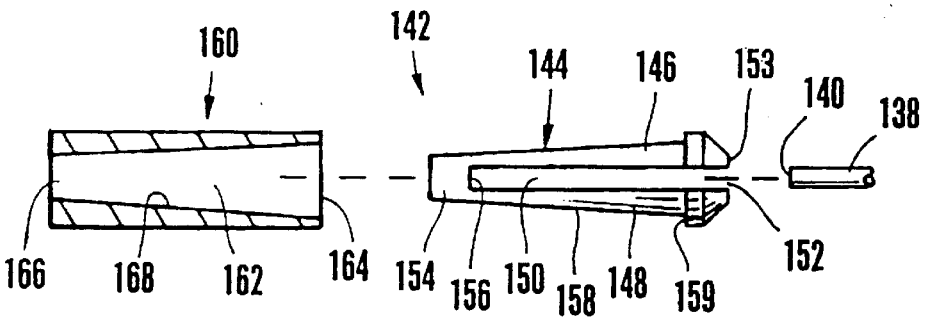
FIG. 7 is an exploded side view of one end of a second embodiment of the present string assembly with a portion of the anchor thereof shown in cross-section.
Figure 8:
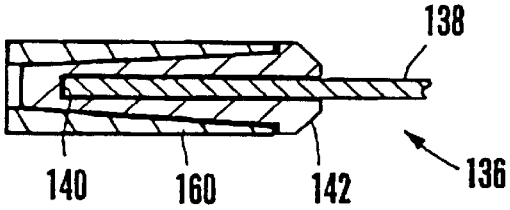
FIG. 8 is a cross-sectional view of the second embodiment of the string assembly shown in assembled position.

FIGS. 7 and 8 illustrate a second embodiment of the string assembly of the present invention. In this embodiment, like reference numerals have been used to designate like components to those of the embodiment shown in FIGS. 2–6. In order to clearly distinguish the features of the two embodiments, the reference numerals of the second embodiment shown in FIGS. 7 and 8 are identified as a 100 series number.

In the second embodiment, a string assembly 136 includes a second string 138 having a first end 140. The second end of the string 138 is not shown but, as discussed in connection with the embodiment of FIGS. 2–6, the second end has an identical structure to that of the first end, and is thus believed to be clearly understood.

A two-piece anchor 142 includes a clamp 144 having a first side wall 146 and a second side wall 148. A slotted passageway 150 extends between an open front section 152 and a closed rear section 154. As in the embodiment of FIGS. 2–6, the closed rear section 154 includes an inside surface 156, which serves the purpose of a locator for the end 140 of the string 138. However, unlike the embodiment of FIGS. 2–6, the front-most shoulder 153 of the embodiment shown in FIGS. 7 and 8 is arranged on the anchor 144, as opposed to the sleeve. The anchor 144 also includes tapered outer walls 158 which have a relatively small diameter at the closed rear section and a relatively large diameter extending toward the front section. This configuration is the opposite of that disclosed in the embodiment of FIGS. 2–6.

As discussed further below with respect to the assembled arrangement of anchor 142, clamp 144 includes a relatively large head portion defining a locking shoulder 159.

A sleeve 160 is the second component of the anchor 142. The sleeve 160 is shown in FIGS. 7 and 8 as a hollow cylinder including a passageway 162 which extends between an open front section 164 and an open rear section 166. Sleeve 160 also includes tapered inner walls 168 which have a relatively small diameter at the open rear section 166 and a relatively large diameter at the open front section 164. The orientation of the taper of the inner walls 168 of sleeve 160 is the opposite of that of sleeve 60.

When manufacturing the string assembly 136, the string 138 should be placed into the slotted passageway 150 of clamp 144 until the end 140 abuts the inside surface 156 of closed rear section 154. The clamp 144 with the string 138 arranged therein is secured in a fixed position. The sleeve 160 may then be moved toward the clamp 144 so that the clamp 144 extends into the passageway 162. As the tapered outer wall 158 of the clamp 144 contacts the tapered inner walls 168 of sleeve 160, clamp 144 is compressed so that the string 138 therein is locked into assembled position with the end 140 remaining in abutment with the inside surface 156 of closed rear section 154.

In this embodiment, it is important for the forward-most shoulder 153 of clamp 144 to extend beyond the forward-most portion of sleeve 160 when the two-piece anchor 142 is assembled. Thus, locking shoulder 169 serves as a safeguard which will engage the end of the forward-most portion of the sleeve 160 adjacent the open front section 164 if too much pressure is applied during the manufacturing process.

Since the distance between the end of the string 140 and its termination point at forward-most shoulder 153 will always be fixed, the locking shoulder 159 need not engage the end of the sleeve 160.

While the foregoing detailed description and drawings are directed toward the preferred embodiments of the present invention, it should be appreciated that numerous modifications can be made to the structure and orientation of the various components of the present stringed instrument. Indeed, such modifications are encouraged to be made in the materials, structure and arrangement of the components of the present stringed instrument without departing from the spirit and scope of the present invention. Accordingly, the foregoing description of the preferred embodiments should by taken by way of illustration rather than by way of limitation as the present invention is defined by the claims set forth below.

I claim:

1. A string assembly for use with a stringed instrument, said string assembly comprising:

a string having a first end and a second end; and a two-piece anchor arranged at said first end, said two-piece anchor including a clamp and a sleeve, said clamp including first and second side walls, an open front section, a closed rear section connected between said first and second side walls, and a passageway extending along said first and second side walls from said open front section to said closed rear section, said first end of said string being arranged within said passageway of said clamp, said sleeve being circumferentially arranged around said clamp and compressing said clamp on said string such that said first end of said string is locked into assembled position within said anchor.

2. The string assembly of claim 1 wherein said first end of said string is arranged in abutment with said closed rear section of said clamp when locked into assembled position within said anchor.

3. The string assembly of claim 1 wherein said anchor has a bullet-shaped configuration.

4. The string assembly of claim 1 wherein said clamp includes first and second opposing slots separating said first and second side walls.

5. The string assembly of claim 4 wherein said sleeve includes a hollow cylinder having tapered end walls which act to compress said clamp upon insertion into said sleeve.

6. The string assembly of claim 1 further comprising a second two-piece anchor, said second two-piece anchor being connected to said second end of said string.

7. The string assembly of claim 1 further comprising a plurality of strings and a plurality of two-piece anchors, each of said strings having one of said two-piece anchors connected to said first end and one of said two-piece anchors connected to said second end.

8. A string assembly for use with a stringed instrument, said string assembly comprising:

a plurality of strings, each having a first end and a second end, and a plurality of two-piece anchors, each of said strings having one of said two-piece anchors arranged at said first end and another one of said two-piece anchors arranged at said second end, each of said two-piece anchors including a clamp and a sleeve, said clamp including first and second side walls, an open front section, a closed rear section connected between said first and second side walls, and a passageway extending along said first and second side walls from said open front section to said closed rear section, said first and second ends of each string being arranged within said passageway in abutment with said rear section of a corresponding one of said clamps, said sleeve of each said anchor being circumferentially arranged around a corresponding one of said clamps and compressing said corresponding clamp on said string such that said first and second ends of said string are locked into assembled position within said anchor.

9. The string assembly of claim 8 wherein said anchors have a bullet-shaped configuration.

10. The string assembly of claim 8 wherein each of said clamps include first and second opposing slots separating said first and second side walls.

11. The string assembly of claim 8 wherein each said sleeve includes a hollow cylinder having tapered inner walls which act to compress a corresponding one of said clamps as said corresponding clamp is inserted into one of said sleeves.

12. A string assembly for use with a stringed instrument, said string assembly comprising:

a string having a first end and a second end; and a two-piece anchor arranged at said first end, said two-piece anchor including a clamp and a sleeve, said clamp including an open front section, a closed rear section, and a passageway extending between said open front section and said closed rear section, said first end of said string being arranged within said passageway and in abutment with said closed rear section of said clamp, said sleeve being circumferentially arranged around said clamp so as to lock said string into assembled position within said anchor.

13. The string assembly of claim 12 wherein said sleeve includes an open front section, an open rear section, and a passageway extending through said open front and rear sections, said passageway having a greater circumference at said rear section than said front section, said sleeve having a shoulder adjacent said passageway at said open front section, said shoulder being the forward-most portion of said anchor when said string assembly is arranged in assembled position within a stringed instrument.

14. The string assembly of claim 12 wherein said sleeve includes an open front section, an open rear section, and a passageway extending through said open front and rear sections, said passageway having a greater circumference at said front section than said rear section, said clamp including a shoulder adjacent said passageway at said open front section thereof, said shoulder being the forward-most portion of said anchor when said string assembly is arranged in assembled position within a stringed instrument.

15. A stringed instrument comprising:

a body;

a neck mounted on said body;

a bridge mounted on said body;

a nut connected to said neck; and a plurality of string assemblies extending between said bridge and said nut, each of said string assemblies including a string having a first end and a second end; and a two-piece anchor arranged at said first end, said two-piece anchor including a clamp and a sleeve, said clamp including first and second side walls, an open front section, a closed rear section connected between said first and second side walls, and a passageway extending along said first and second side walls from said open front section to said closed rear section, said first end of said string being arranged within said passageway of said clamp, said sleeve being circumferentially arranged around said clamp and compressing said clamp on said string such that said first end of said string is locked into assembled position within said anchor.

16. The stringed instrument of claim 15 wherein said two-piece anchor is secured to one of said bridge or said nut.

17. The stringed instrument of claim 16 wherein said first end of said string is arranged in abutment with said closed rear section of said clamp when locked into assembled position within said anchor.

18. The stringed instrument of claim 16 wherein said anchor has a bullet-shaped configuration.

19. The stringed instrument of claim 16 wherein said clamp includes first and second opposing slots separating said first and second side walls.

20. The stringed instrument of claim 16 wherein said sleeve includes a hollow cylinder having tapered end walls which act to compress said clamp upon insertion into said sleeve.

21. The stringed instrument of claim 16 further comprising a second two-piece anchor, said second two-piece anchor being connected to said second end of said string.

22. The stringed instrument of claim 16 further comprising a plurality of strings and a plurality of two-piece anchors, each of said strings having one of said two-piece anchors connected to said first and one of said two-piece anchors connected to said second ends.

23. A stringed instrument comprising:

a body;

a neck mounted on said body;

a bridge mounted on said body;

a nut connected to said neck; and a plurality of string assemblies extending between said bridge and said nut, each of said string assemblies including a plurality of strings, each having a first end and a second end, and a plurality of two-piece anchors, each of said strings having one of said two-piece anchors arranged at said first end and another one of said two-piece anchors arranged at said second end, each of said two-piece anchors including a clamp and a sleeve, said clamp including first and second side walls, an open front section, a closed rear section connected between said first and second side walls, and a passageway extending along said first and second side walls from said open front section to said closed rear section, said first and second ends of each string being arranged within said passageway in abutment with said rear section of a corresponding one of said clamps, said sleeve of each said anchor being circumferentially arranged around a corresponding one of said clamps and compressing said corresponding clamp on said string such that said first and second ends of said string are locked into assembled position within said anchor.

24. The stringed instrument of claim 23 wherein said anchors have a bullet-shaped configuration.

25. The stringed instrument of claim 24 wherein each of said clamp includes first and second opposing slots separating said first and second side walls.

26. The stringed instrument of claim 24 wherein each said sleeve includes a hollow cylinder having tapered inner walls which act to compress a corresponding one of said clamps as said corresponding clamp is inserted into one of said sleeves.

27. A method of securing an anchor to a guitar string comprising the steps of:

providing a string;

providing a two-piece anchor assembly including a clamp and a sleeve, said clamp having an open front section, a closed rear section, and a passageway extending from said open front section to said closed rear section;

arranging an end of said string within said passageway of said clamp in abutment with said closed rear section thereof; and arranging said sleeve over said clamp and forcing said clamp into said sleeve to a desired position where said string is locked in assembled position within said anchor such that said end of said string remains in abutment with said closed rear section of said clamp.

28. The method of claim 27 wherein said sleeve includes an open front section, an open rear section, and a passageway extending through said open front and rear sections, said passageway having a greater circumference at said open rear section than said open front section and being tapered therebetween, said step of forcing said clamp into said sleeve comprises initially placing said open front section of said clamp through said open rear section of said sleeve and forcing said clamp toward said open front section of said sleeve until said front section of said clamp is at a predetermined position with respect to said front section of said sleeve whereby said tapered passageway compresses said clamp to lock an end of said string into assembled position within said anchor.

29. The method of claim 28 wherein a machine including a plunger is used to force said clamp toward said open front section of said sleeve.

30. The method of claim 28 wherein a micrometer is used to control insertion of said clamp within said sleeve to a desired position.

31. The method of claim 27 wherein said sleeve includes an open front section and an open rear section, and a passageway extending through said open front and rear sections, said passageway having a greater circumference at said open front section than said open rear section and being tapered therebetween, said step of forcing said clamp into said sleeve comprises initially placing said closed rear section of said clamp through said open front section of said sleeve, and forcing said clamp toward said open rear section of said sleeve whereby said tapered passageway compresses said clamp to lock an end of said string into assembled position within said anchor.

32. The method of claim 31 wherein a machine including a plunger is used to force said clamp toward said open rear section of said sleeve.

33. The method of claim 31 wherein said clamp is forced rearwardly into said sleeve at a predetermined set pressure.

34. A method of securing an anchor to a guitar string comprising the steps of:

providing a string;

providing a two-piece anchor assembly including a clamp and a sleeve, said clamp having an open front section, a rear section, and a passageway extending from said open front section to said rear section;

arranging an end of said string within said passageway of said clamp at a precise location which does not extend beyond said rear section thereof; and arranging said sleeve over said clamp and forcing said clamp into said sleeve to a desired position where said string is locked in assembled position within said anchor such that said end of such string remains in said precise location with respect to said rear section of said clamp.

* * * * *